United States Patent [19]

Cousin et al.

[11] Patent Number: 4,554,181

[45] Date of Patent: Nov. 19, 1985

[54] INK JET RECORDING SHEET HAVING A BICOMPONENT CATIONIC RECORDING SURFACE

[75] Inventors: Michael J. Cousin, Ashville; Larry O. Hill, Frankfort; Rhonda G. Justice, Waverly, all of Ohio

[73] Assignee: The Mead Corporation, Dayton, Ohio

[21] Appl. No.: 607,890

[22] Filed: May 7, 1984

[51] Int. Cl.[4] ..... B41M 5/00

[52] U.S. Cl. ..... 427/261; 346/135.1; 427/288; 428/207; 428/211; 428/341; 428/342; 428/470; 428/537.5

[58] Field of Search ..... 346/1.1, 135.1; 400/126; 427/261, 288; 428/207, 211, 537.5, 341, 342, 411.1, 470

[56] References Cited

U.S. PATENT DOCUMENTS

| | | |
|---|---|---|
| 3,011,918 | 12/1961 | Silvernail et al. . |
| 3,544,318 | 12/1960 | Boothe et al. . |
| 3,813,264 | 5/1974 | Boothe et al. . |
| 3,920,855 | 11/1975 | Dawson et al. . |
| 4,018,826 | 4/1977 | Gless, Jr. et al. . |
| 4,051,138 | 9/1977 | Wang et al. . |
| 4,088,530 | 5/1978 | Chan et al. . |
| 4,148,639 | 4/1979 | Sinkovitz et al. . |
| 4,171,417 | 10/1979 | Dixon . |
| 4,197,135 | 4/1980 | Bailey et al. . |
| 4,269,891 | 5/1981 | Minagawa . |
| 4,282,059 | 8/1981 | Davidson . |
| 4,308,542 | 12/1981 | Maekawa et al. . |
| 4,316,943 | 2/1982 | Sinkovitz et al. . |
| 4,371,582 | 2/1983 | Sugiyama et al. . |
| 4,381,185 | 4/1983 | Swanson et al. . |
| 4,425,405 | 1/1984 | Murakami et al. . |
| 4,446,174 | 5/1984 | Maekana et al. ..... 428/331 |

FOREIGN PATENT DOCUMENTS 52-74340 6/1977 Japan .

OTHER PUBLICATIONS

"Paper Requirements for Color Imaging with Ink--Jets", McManus et al., TAPPI Journal, vol. 66, No. 7, Jul. 1983.

Chemical Abstract No.: 100:87543j, Ink-Jet Printing Paper, Canon K.K. Jpn. Kokai Tokkyo, JP 57,173,194, [82,173,194], Oct. 25, 1982, Appl. 81/58, 173, Apr. 17, 1981, 5 pages.

Chemical Abstract No. 100:77463u, Recording Sheet Mitsubishi Paper Mills, Ltd., Jpn. Kokai Tokkyo Koko JP 58,177,390, [83,177,390], Oct. 18, 1983, Appl. 82/61,370, Apr. 13, 1982, 6 pages.

*Primary Examiner*—Bruce H. Hess

*Attorney, Agent, or Firm*—Biebel, French & Nauman

[57] ABSTRACT

An ink jet recording sheet having a recording surface which includes a combination of a water soluble polyvalent metal salt and a cationic polymer, said polymer having cationic groups which are available in the recording surface for insolubilizing an anionic dye.

30 Claims, No Drawings

INK JET RECORDING SHEET HAVING A BICOMPONENT CATIONIC RECORDING SURFACE

The present invention relates to a recording sheet suitable for use in ink jet recording.

Ink jet recording processes have emerged as one of the most important technologies for high speed electronic printing. With their emergence there has arisen a need for specialty papers having particular recording properties.

The basic imaging technique in ink jet recording involves the use of one or more ink jet assemblies connected to a source of ink. Each ink jet includes a small orifice which is electromagnetically energized by magnetorestrictive, piezoelectric, thermal, or similar means to emit uniform droplets of ink as a continuous stream or as individual droplets on demand. The droplets are directed onto the surface of a moving web and controlled to form printed characters.

The quality of the record obtained in an ink jet recording process is highly dependent on jet operation and the properties of the ink and the recording paper. The ink must be capable of forming stable ink droplets under pressure and must readily emerge from the ink jet orifice. Aqueous inks containing a water soluble dye and a humectant to prevent the ink from drying out in the jet assembly have been found to be particularly desirable. However, the absorption of these inks by the recording sheet has been somewhat problematic particularly in the area of multicolor printing where two or more ink drops may overlap on the surface of the recording sheet.

To obtain good image quality, the recording sheet must absorb the ink rapidly and at the same time insolubilize the ink dye on the sheet surface. The former property reduces the tendency for set-off (i.e., transfer of the ink from the paper to sheet handling rollers and the like) whereas the latter property insures that images having high optical density are obtained. Unfortunately, these two properties are in conflict with one another. Papers having high absorbency draw the ink deeply into the paper and, as a result, the optical density of the image formed at the paper surface is reduced. They also suffer from feathering, poor edge acuity, and show-through. Papers with low absorbency, such as highly sized papers, provide good optical density by retaining the ink at the paper surface but have a high tendency to set-off because the ink vehicle is not absorbed rapidly.

The perfect ink jet recording sheet has been described as a blotter with a magic film. The blotter rapidly absorbs the ink vehicle while the magic film insures that the colorant is retained at the surface of the sheet where its light absorbing and reflecting properties are greatest. If the colorant is carried deeply into the paper web, its absorbing strength is reduced, web fibers conduct the ink laterally and poor image sharpness and show-through occurs. See P. A. McManus et al, "Paper Requirements for Color Imaging with Ink Jets", *TAPPI*, Vol. 66, No. 7, July, 1983, pp. 81-5.

Some of the efforts which have been directed to developing ink jet recording sheets have adjusted the basis weight, apparent density and filler content of the paper to obtain modified absorption properties (see Japan Kokai No. 74340/1977 to Jujo Paper Mfg. Co.). Other efforts have added certain cationic sizing agents, such as cationized petroleum resins, to the paper in the size press to achieve more desirable ink absorption characteristics (see Japan Kokai No. 109783/1981 to Mitsubishi Paper Mills, Ltd.). Still other efforts have provided a dye absorbing layer containing certain dye mordants on the surface of the recording sheet.

U.S. Pat. No. 4,371,582 to Sugiyama et al describes a recording sheet containing a cationic polymer latex which is designed to be used in ink jet recording with water soluble dyes to improve water fastness. The preferred cationic polymers are water insoluble and copolymers of a monomer containing a tertiary amino group or a quaternary ammonium group and a copolymerizable ethylenically unsaturated compound. The insoluble polymer is applied to one surface of the recording sheet as a latex and interacts with water-soluble dyes containing a sulfo group for which it has strong mordanting power.

U.S. Pat. No. 4,381,185 to Swanson et al discloses a process for printing with water soluble polymeric dyes in which the paper contains cationic groups. The cationic groups can be introduced into the paper through the addition of an organic additive such as a cationic polyamine or an inorganic additive such as calcium chloride, barium acetate, or aluminum nitrate.

Prior efforts to improve the quality of images obtained using specialty ink jet recording papers such as those described above have not satisfactorily resolved the conflict between high absorbency and image quality. There is still a need for improvement particularly in the area of achieving rapid insolubilization of the ink dye, water fastness, and reduced feathering.

SUMMARY OF THE INVENTION

A principal object of the present invention is to provide an ink jet recording sheet which can provide fast setting, non-offsetting images having high density and good water fastness.

According to one embodiment of the present invention, a recording sheet is provided comprising a substrate having a recording surface including a water soluble polyvalent metal salt and a cationic polymer wherein the polymer contains cationic groups which are available for ionically interacting with an anionic dye and insolubilizing it. The recording surface may be formed by applying an aqueous solution of the aforesaid salt and polymer to the surface of an absorbent sheet material such as paper or by applying a coating containing the polymer and salt combination alone or in combination with a binder which may be water swellable and other additives to the surface of a substrate such as paper or plastic film.

The ink jet recording paper of the present invention provides recording properties which are not available when either the polyvalent metal salt or the cationic polymer is used alone in the recording surface. As a result, higher quality images which more closely simulate type set images are obtained.

One of the drawbacks of using a cationic polymer alone in the recording surface is that the ink must wet the surface before the polymer can insolubilize the dye. A further disadvantage is that the polymer may have a wetting delay and thus tends to prevent the ink drops from being rapidly absorbed by the recording sheet. As a result, recording surfaces containing only cationic polymers have a high tendency for set-off. The dye remains in solution on the surface of the surface of the recording sheet long enough to be smeared by paper handling means in the printer. After printing, these sheets must be allowed to dry before they can be transported from the printer or other means must be adopted to insure that the images are not smudged upon further processing. This slows down and restricts the printing process.

In accordance with the present invention, a water soluble polyvalent metal salt is used in combination with the cationic polymer in the recording surface. As a result of the salt addition, the dye contained in the ink is set (insolubilized) more rapidly and concomittantly there is substantially less tendency for set-off. It is believed that the salt rapidly dissolves in the ink drop that strikes the surface of the paper and hence the drop does not need to fully wet the surface before the dye can be insolubilized. Thus the salt contributes rapidity of set to the recording surface. The recording sheets of the present invention have also been found to exhibit less curl upon drying. Very often untreated recording sheets curl or buckle especially when heavy amounts of ink are applied over a relatively large area, and this detracts from the quality of the record sheets.

When the salt is used alone on the recording surface, rapid set can be achieved but the water fastness of the image is not good and there is a tendency for feathering to occur. This is because the dye-salt complex does not exhibit good adherence to the recording sheet. Tne cationic polymer supplies such adherence in the present invention by forming a network of polymeric bridges between the substrate and the dye which tends to improve water fastness and reduce feathering. Thus, by using the salt and polymer together with a judicious choice of substrates, a recording sheet which more closely imitates a "blotter with a magic film" is obtained and images of improved density, water fastness and sharpness are achieved.

A further advantage of combining a water soluble salt and cationic polymer in the recording surface is that the combination enables the paper manufacturer to adjust the recording properties of a paper for a particular recording ink so as to optimize image quality. In particular, some commercially available recording inks contain dyes which are more difficult to insolubilize than others. In some cases the dyes cannot be rapidly insolubilized using one combination of salt and cationic polymer; but by using another combination, for example, a combination containing a higher valency salt, these dyes can be effectively insolubilized. Thus, the combination of salt and polymer gives the paper manufacturer a means for fine tuning the recording properties of his product to improve record quality.

In accordance with the more preferred embodiments of the present invention, the cationic polymer is a polymeric cationic amine such as a quarternary amine or an easily protonated tertiary amine having a nitrogen content in excess of 3.0%, and the polyvalent metal salt is a salt of cation selected from the group consisting of $Ba^{2+}$, $Ca^{2+}$, $Al^{3+}$, $Zr^{4+}$, and $Zn^{2+}$ and an anion of an acid having a pKa value greater than 2.0.

DETAILED DESCRIPTION OF THE INVENTION

The cationic polymers used in the present invention are characterized in that in the recording surface they contain cationic groups which are available for dye insolubilization. These cationic groups carry counter ions that will exchange with an anionic dye and cause the dye to precipitate from the ink solution.

The cationic polymers used in the present invention are generally characterized by a higher degree of cationic functionality than is found in the polymers which are conventionally used as sizing agents in the paper industry. The cationic functionality in a sizing agent is approximately equivalent to or less than the amount of anionic functionality in paper and is used to bind the sizing agent to the paper to impart a degree of hydrophobic nature to it. As such, in paper a conventional sizing agent does not have cationic groups available for dye insolubilization.

Certain cationic polymers used as retention aids in the paper industry have higher cationic character and can be used in the recording surface of the present invention if they are added to the paper after sheet formation. However, when the same polymers are used conventionally as retention aids, they are added at the wet end of the papermaking process and they pick up counter ions which will not exchange for the anionic dye. Hence, in conventional papers in which these polymers are used as retention aids, the polymers do not contain cationic groups which are available for dye insolubilization.

In accordance with the preferred embodiments of the present invention the cationic polymers are polymeric amines such as polymers of quaternary amines or amines which are converted to quaternary amines under acid conditions. The cationic character of these polymers can be expressed as a nitrogen concentration since the nitrogen present in the polymers generally is in the form of cationic quaternary ammonium groups. Thus, the polymeric cationic amines used in the present invention can be further characterized as having a nitrogen content in excess of about 0.1%, preferably in excess of 1.5% and still more preferably in excess of 3.0% by weight.

Many of the cationic polymers used in the present invention are commercially available materials whose exact composition is not known to the applicants. It can generally be said, however, that polymers in which at least about 3 mol % of the monomeric units forming the polymer are derived from cationic monomers will have cationic groups available for dye insolubilization when they are used in the recording surface of the present invention. Polymers in which at least about 10 mol % and up to 100% mol of the monomeric units are cationic are preferred.

A screening test can also be used to determine cationic polymers which are useful in the present invention. This test is based on the ability of a solution containing a predetermined concentration of the polymer to flocculate a 3% solution of Direct Black 19 dye. In accordance with this test a solution containing 1 g of cationic polymer and 20 g deionized water is prepared and one drop of an aqueuous solution prepared by dissolving 3.0 g Direct Black 19 in 97.0 g deionized water is added thereto. Those polymers which flocculate the dye such that upon filtering the test solution a clear aqueous solution containing essentially no dissolved dye is obtained are useful in the present invention. Polymers which flocculate the dye more rapidly than others and from which the dye has the least tendency to redissolve are preferred.

A useful class of cationic polymers are so-called electroconductive polymers which are conventionally used in electrophotographic, electrographic or electrostatographic processes. Examples of such polymers are described in U.S. Pat. Nos. 3,011,918; 3,544,318; 4,148,639;

4,171,417; 4,316,943; and 3,813,264. These polymers are characterized by the presence of a high percentage of cationic groups such as tertiary amino and quaternary ammonium cationic groups. Representative polymers are homopolymers or copolymers of cationic monomers such as quaternary diallyldiakylammonium chlorides such as diallyldimethylammonium chloride, N-alkylammonium chlorides, methacrylamidopropyltrimethylammonium chloride, methacryloxyethyl trimethylammonium chloride, 2-hydroxy-3-methacryloxypropyl trimethylammonium chloride, methacryloxyethyl trimethylammonium methosulfate, vinylbenzyl trimethylammonium chloride and quaternized 4-vinylpyridine.

Representative examples of commercially available cationic polymers that are useful in the present invention are Warcofix 808 (a guanidine-formaldehyde polymer available from Sun Chemical Corp), Calgon 261 LV and Calgon 7091 R.V. (polydimethydiallylammonium chlorides available from Calgon Corp.), Nalco 8674 (a cationic polyamine available from Nalco Corp.), and CAT Floc C (a cationic homopolyme available from Calgon Corp.)

Both water soluble cationic polymers and cationic latices may be used in the present invention. Water soluble polymers (i.e., polymers soluble in water in an amount greater than 20 g/100 ml at 23° C.) can be applied as an aqueous solution and are preferred for use in the present invention because they can be uniformly applied to the surfaces of paper fibers without blocking the porous network of the paper sheet and interfering with ink absorption. The use of cationic latices is preferably restricted to those embodiments in which the recording surface is formed by overcoating the surface of a paper or plastic substrate with a coating composition. The cationic polymers present in latices are water insoluble pigments or beads which can substantially reduce the absorbancy of the paper substrate when they are applied in a coat weight which is high enough to insure that any drop of ink impinging the surface of the paper will strike a latex bead. When these latices are used in lower amounts, ink drops may strike the recording sheet between the polymeric beads and not be properly absorbed. Latices are also disadvantageous because they can be destabilized by the addition of salts.

The polyvalent metal salts used in the present invention are water soluble salts of polyvalent cations from Group II, Group III or the Transition Metals of the Periodic Table of Elements. Typically, these salts can be dissolved in water in an amount greater than 5 g/100 ml at 23° C. The most readily available and cost effective salts are $Zn^{2+}$, $Al^{3+}$, $Mg^{2+}$, $Ca^{2+}$, $Zr^{4+}$, and $Ba^{2+}$ salts. Salts which tend to color the paper such as $Fe^{2+}$, $Fe^{3+}$, and $Cu^{2+}$, while functional, must be used in limited amounts or not at all. Preferably, the salts are salts of one of the aforesaid polyvalent cations and an anion of a weak acid such as an anion of an acid having a pKa value greater than 2.0 and, more preferably, greater than 3.0. Salts of strong acid anions such as alum are capable of insolubilizing an ink jet dye but are generally undesirable because they impart high acidity to the paper which accelerates degradation. Thus, while chlorides, sulfates, chlorates, and nitrates are useful, the preferred salts are acetates, formates, chlorohydrates, malonates, succinates, and salts of other weak organic acids.

Specific examples of salts useful in the present invention are alum, calcium formate, and aluminum chlorohydrate. Certain zirconium salts are also believed to be useful such as zirconium oxychloride and zirconium hydroxychloride.

The salt is preferably used in an amount of about 10 to 1,000 parts and, more preferably, 25 to 200 parts and still more preferably 75 to 125 parts by weight per 100 parts by weight cationic polymer. The salt and polymer can be applied to the substrate in any amount which effectively insolubilizes the dye. Typically this amount ranges from approximately 0.1 to 15 g/m$^2$ (dry weight) per side.

The recording sheet of this invention may be formed from a paper, synthetic paper, or plastic film substrate. The recording surface may be applied by either spraying or immersing those substrates which are porous with an aqueous solution of the cationic components, or by preparing a coating composition and forming a coated paper product or transparency. One embodiment of the present invention is low size or bond paper having the cationic polymer or salt absorbed on one or both faces. A second embodiment of the present invention is a paper coated with a composition including a water swellable or water penetrable coating such as gelatin-baryta coating which includes a cationic polymer and salt. Still another embodiment of the invention is a plastic film which carries a coating containing a cationic polymer and salt and optionally a water penetrable binder.

There is generally no restriction on the types of paper that may be used in the present invention. For most applications, papers having a basis weight in the range of 12 to 30 pounds per 1300 sq. ft., apparent density in the range of 0.3 to 1.2 and filler content of 0 to 40% are useful. Waterleaf, low size (Bristow Ka=77 ml/M$^2$.sec$^{\frac{1}{2}}$), high size (Bristow Ka=3 ml/M$^2$.sec$^{\frac{1}{2}}$), and bond paper are useful. Waterleaf and low size bond paper are preferred for many applications. The papers used in the present invention can be formed from substantially any commercially available pulp, but pulps which give papers having very uniform absorption characteristics are preferred.

Recording paper is most conveniently and economically prepared by applying an aqueous solution of the cationic polymer and salt to one or both surfaces of a paper in the papermaking process after sheet formation—that is after the sheet is capable of sustaining its own weight. It is particuarly convenient to add the salt and polymer to the sheet in the size press but it can be added anytime after the paper has been dewatered or left the wire, including after the papermaking process has been essentially completed. The salt and polymer cannot be added to the paper at the wet end of the papermaking process because the polymer will act as a retention aid and its cationic groups will react with fines and fiber in the pulp furnish and thereafter be unable to insolubilize dye. Solutions which are preferred for use in a size press contain about 1 to 30% resin and about 1 to 30% salt by weight.

Coated paper products can be prepared by incorporating a water soluble polyvalent metal salt and a cationic polymer or latex into a conventional paper coating composition and applying the coating to the paper substrate using conventional coating techniques. Such conventional coatings typically include a white pigment such as clay (e.g., bentonite), diatomaceous earth, baryta, and/or calcium carbonate; and a binder such as gelatin, etherified starch, or polyvinyl alcohol. U.S. Pat. No. 4,425,405 to Murakami et al describes a coating composition containing a white filler and polyvinylpyrrolidone. Another example of a coated ink jet paper is a paper coated with a mixture of a hygroscopic polymer, a cationic resin and salt. Hygroscopic polymers useful in the present invention are described in Japanese Kokai No. 57-173,194 and include such polymers as methacrylic acid starch copolymer. Preferably the salt and the cationic polymer are added to these compositions in an amount of about 0.1 to 30 parts per 100 parts composition.

In a further embodiment of the invention, a coated paper product can be formed by applying an aqueous solution of the salt and polymer to one or both faces of a paper sheet as described above (e.g., at the size press) and overcoating the sheet with a water based binder/-white filler coating composition. Upon application of the latter coating, the polymer and salt migrate from the paper sheet into the coating where they impart their desirable ink jet recording characteristics.

Synthetic pulp papers include papers made up of synthetic pulp and wood pulp and those made up of synthetic pulp alone. Typical synthetic pulps are homopolymers and copolymers of vinyl monomers such as ethylene, propylene, styrene, vinyl acetate, acrylic esters, polyamides, and polyesters. Polyethylene synthetic pulps are preferred. In using wholly synthetic papers, it is desirable to treat the paper to enhance the adherence of the polymer and salt such as by subjecting the paper to corona discharge or by adding of a water swellable film forming binder or coupling agent to the recording surface composition to bind the surface to the substrate.

In accordance with one embodiment of the present invention, the ink jet recording sheet is formed on a transparent plastic substrate. The selection of the substrate is not particularly critical, although thermoplastic films are generally used for this purpose. Representative examples of useful thermoplastic films include polyethylene terephthalate, polystyrene, polyvinyl chloride, polymethylmethacrylate, polyethylene, and cellulose acetate.

The recording surface of the present invention can be applied to synthetic paper or plastic films using conventional coating techniques. In this case, it may be desirable include a binder which may be water swellable in the coating composition. Representative water swellable binders are etherified starch, gelatin, polyvinyl alcohol, poly(hydroxyethyl acrylates), poly(hydroxyethyl methacrylates), carboxyethylcellulose, carboxymethylcellulose, hydroxyethylcellulose, hydroxypropylcellulose, polyacrylates, polymethacrylates, poly(vinyl pyrrolidone), poly(ethylene oxide), etc. Usually the binder is used in an amount of about 1 to 2000 parts by weight per 100 parts by weight of the cationic polymer and salt. It is also envisioned that the ability of coatings for synthetic films and papers to absorb liquid can be enhanced by adding a small amount of a pigment to the coating. In the case of transparencies, the amount of pigment must be low enough not to substantially opacify the support.

The ink jet recording sheet of the present invention operates by ionically bonding the water soluble cationic dye to a surface of the substrate. Water soluble acid dyes and direct dyes are useful in the present invention. Such dyes are well known to those skilled in the art and commercially available. Representative examples of useful dyes include acid dyes such as Tartrazine (CI 19140), Quinoline Yellow (CI 47005), Eosin (CI 45380), Erythrosine (CI 45430), Brilliant Cyanine 6B (CI 42660), Acid Black 1 (CI 20470), Acid Black 36 (CI 27275) and Acid Blue Black 10B (CI 20470), Acid Blue 193 (CI 15707), Acid Blue 194 (CI 17941), Acid Blue 249 (CI 74220); and direct dyes such as Direct Black 19, Direct Black 49, Direct Black 56, Direct Black 74, Direct Black 103, Direct Black GW, Capamine Black ESA, Deep Black XA (CI Direct Black 154), Black G (CI 35255), Phthalocyanine Blue (CI 74180), Direct Blue 78, Direct Blue 239, Direct Blue 120, Direct Blue 110, Direct Blue 19, Direct Scarlet 4BS (CI 29160). The CI number in the description above indicates the identification number in the Color Index, 3rd Edition, the Society of Dyers and Colorists, Bradford, Yorkshire (1971).

The aqueous ink jet printing inks used in conjunction with the present invention may be formulated in a conventional manner with various additives such as humectants, solubilizing agents, surface active agents, and the like.

The ink composition will effect the recording properties achieved using the recording sheets of the present invention. As previously indicated, certain dyes are more difficult to insolubilize than others. In some cases it may be desirable to use a trivalent salt instead of a calcium salt, for example, to enhance insolubilization. To enhance water absorbancy it may be desirable to incoporate high absorbancy pigments in the recording surface or in the base paper. Examples of such pigments are calcium carbonate, clays, aluminum silicates, urea-formaldehyde fillers, and the like. These pigments may be added to a solution of the salt and polymer in the size press or incorporated into a coating composition.

By including cationic or non-ionic surfactants in the recording surface, the speed with which the ink wets the surface can be increased and thereby rapidity of set and absorption enhanced.

The present invention is explained in more detail by reference to the following examples. Unless otherwise indicated, all parts, percentages and amounts are by weight. Commercial products were used in the form as received from the manufacturer.

The test procedures described below were used to compare and evaluate the test sheets described in the Examples.

Spray Tester

A spray tester was used to apply uniform amounts of ink to the test sheets. The tester employs an automatic air atomizing nozzle (Model 1/8 JJAU J-14, E. J. Pfaff Co.) which is connected to a pressurized ink source by 0.25 inch plexiglass tubing and adjustably mounted above a double pinch belt system which functions as a paper transport, and moves the test sheets. The sheets are moved along the transport as ink is applied by electrically and pneumatically controlling the air atomizing nozzle. By adjusting transport speed, atomizing air pressure, liquid pressure, and the height of the spray nozzle above the paper, ink application rates can be varied from 3 to 30 g/m$^2$. Unless otherwise indicated, the tester is operated by running the belt system at 8 inches/-sec., setting the liquid pressure at 6 psig and the air pressure at 30 psig such that 12 g/m$^2$ of ink is applied to the test sheets and the area covered by the ink is about $2\frac{1}{2} \times 5\frac{1}{2}$ inches.

Offset

Offset measures the tendency of the ink to set off as the paper is handled during the recording process and is expressed in terms of the amount of time (seconds) until no offset is observed. Offset is measured by placing a rubber offset wheel 1 inch wide and 1 inch in diameter in the paper path downstream of the atomizing nozzle and applying 1 pound pressure to the wheel. The paper passes under the wheel as it travels along the paper path. If the ink offsets, the offset wheel leaves a track across the sheet. By adjusting the position of the wheel in the paper path and stopping the paper for a predetermined time if necessary, the time to no offset can be determined. Generally, a short time to no offset is preferred.

Optical Density

The Spray Tester is used to apply a 12 g/m$^2$ layer of ink on the wire or felt side of a sheet of paper. The sprayed image is allowed to dry and the image intensity (optical density) is measured by randomly taking ten readings in the inked area using a MacBeth 512 densitometer. The readings are averaged and the resulting number recorded as the image intensity for that side of the test sheet.

Feathering

A fountain pen equipped with an Esterbrook 2668 tip is attached to a Bristow tester at an angle of 55° to the tangent of the Bristow wheel at a point 4 inches (clockwise) from where the Bristow headbox normally touches the paper. The headbox assembly is not used for this test. The pen is allowed to float on the paper surface; thus, the weight of pen, 10.2 grams, regulates its contact pressure with the paper. A 1×11 inch grain long paper specimen is attached to the Bristow tester wheel and the linear speed adjusted to 0.606 cm/sec. As the paper passes under the pen, a line is drawn the length of the specimen. A representative 2 inch length of lined paper is selected and mounted on a 1×3 inch glass microscope slide. A Quantimet Image Analyzer is used to measure the actual perimeter of the trace line made by the fountain pen. A 10 mm or greater trace length is examined and the percent increase in the perimeter of the trace line is determined.

Show Through

Show through is a measure of the amount of ink penetration through a printed sheet of paper. It is evaluated by reading the back side of a 12 g/m$^2$ printed sheet with a MacBeth 512 densitometer.

Waterfastness

A test sheet is sprayed with 12 g/m$^2$ of ink using the spray tester. The sprayed specimen is cut in half. One half is put aside for optical density measurements and the other half is placed into a cup of deionized water. The time interval between ink application and placement into the water is 1 minute. After the inked sample has soaked for 1 minute, it is dipped up and down in the water to assure that all the dissolved ink is removed. The specimen is removed and allowed to drip dry. After drying, the image densities of the soaked half and the unsoaked half of the test sheets are read using the MacBeth 512 densitometer. The difference between these densitometer readings is termed waterfastness and is recorded as the loss in optical density resulting from 1 minute soaking.

Curl Testing

A test was developed using the Bristow tester to measure the extent to which a test sheet curls when wetted and allowed to dry. A test sheet is allowed to humidify in a room with 50% relative humidity. Then a sheet is cut into machine direction strips which are 51 mm wide and 280 mm long. Each strip is taped to the wheel on a Bristow tester, with the inside edge of the wheel 2 mm from the edge of the headbox. With 40 ul of ink in the headbox, the Bristow tester is set to a speed which applies approximately 10 g/m$^2$ ink to the strip. As soon as the ink is applied, the strip is removed from the wheel and cut crosswise into 29 mm sections, so that each test piece measures 51×29 mm. The ink trace is 2 mm from one edge and 31 mm from the other. The test pieces (5 pieces for each trace) are allowed to freely curl as they dry. After approximately 30 minutes, curl is measured by placing a weight on the 2 mm edge of each test piece and measuring the height of the other edge above the first by measuring both corners and taking the average. The maximum height possible is 42 mm. The five averaged readings from the curled pieces of paper are averaged to get the final curl height. These measurements of height are converted to curvature and expressed in units of meters$^{-1}$.

EXAMPLE 1

Moistrite X-02 xerographic and offset paper (a product of The Mead Corporation) was treated in a size press with a solution prepared by dissolving 1000 parts Nalco 8674 resin (a product of Nalco Corp.) and 1000 parts alum in 2500 parts by weight deionized water. The solution was applied to both sides of the paper in a total amount of 8.6 g/m$^2$ on an oven dry basis. The recording properties of the test sheet were evaluated as outlined above. In Table 1 below the recording properties of the test sheet are compared with those of an untreated sheet of the same nature. The designations (W) and (F) refer to the wire side and the felt side, respectively, of the test sheet. The results in Table 1 show that each of optical density, water fastness, offsetting, feathering and curl are improved using the recording surface of the present invention.

TABLE 1

| | Untreated | | Treated | |
|---|---|---|---|---|
| | W | F | W | F |
| Optical Density | 1.14 | 1.10 | 1.26 | 1.16 |
| Water Fastness (loss in O.D. from 1 min. soak) | .59 | .42 | .04 | 0 |
| Offsetting (seconds to no ink set-off) | 4 | 10 | 2 | 3 |
| Feathering (% increase in perimeter of trace line) | 213 | 182 | 119 | 55 |
| Curl (m$^{-1}$) | 67 | 53 | 8 | 1 |

EXAMPLE 2

Both sides of a base sheet of waterleaf were treated in a laboratory size press with a solution prepared by dissolving 200 parts Nalco 8674 resin and 100 parts calcium formate in 500 parts deionized water and dried. The recording properties of the treated sheet and an otherwise identical untreated sheet are shown in Table 2. These results show that very absorbent base sheets, such as waterleaf, which would otherwise provide very poor image density, show-through, and high feathering can be used effectively in the present invention.

TABLE 2

| | Untreated | Treated |
|---|---|---|
| Optical density | 1.06 | 1.29 |
| Show through density | 0.28 | 0.15 |
| Waterfastness (loss in O.D. from 1 min. soaking) | 0.36 | 0 |

TABLE 2-continued

| | Untreated | Treated |
|---|---|---|
| Feathering (% increase of perimeter of trace line) | 310 | 62 |

EXAMPLE 3

Both sides of sheets of unsized bond paper were treated in a laboratory size press with aqueous solutions prepared by dissolving calcium formate and CAT FLOC C (a product of Calgon Corp.) in deionized water in the amounts shown in Table 3 and the recording properties of the sheets were compared. The results are shown in Table 3 wherein it can be seen that test sheets treated with a combination of salt and cationic resin provide high optical density, reduced feathering, good waterfastness and low curl. By comparison, the use of the cationic resin alone provides a recording sheet having good waterfastness, reduced feathering and curl but relatively poor optical density. Test sheets treated with the salt alone exhibit reduced waterfastness and high feathering.

TABLE 3

| | | | | | | Recording Characteristics | | | | |
|---|---|---|---|---|---|---|---|---|---|---|
| Sample | Calcium Formate (parts) | Cat Floc (parts) | Water (parts) | Calcium Formate ($g/m^2$) | Cat Floc C ($g/m^2$) | Optical Density | Offsetting (Sec. to No Ink Set-Off | Waterfastness (Loss in O.D. From 1 Min. Soak) | Feathering (% Increase in Perimeter of Trace Line) | Curl ($m^{-1}$) |
| A | — | — | — | 0 | 0 | 1.13 | 4 | 0.42 | 174 | 67 |
| B | 50 | 0 | 950 | 1.3 | 0 | 1.19 | 2.5 | 0.06 | 102 | 32 |
| C | 100 | 0 | 900 | 2.6 | 0 | 1.27 | 4.5 | 0.05 | 122 | 31 |
| D | 0 | 341 | 659 | 0 | 5.7 | 1.04 | 4 | 0 | 31 | 12 |
| E | 50 | 227 | 732 | 1.5 | 3.0 | 1.25 | 5 | 0 | 30 | 30 |

EXAMPLE 4

Both sides of unsized sheets of bond paper were treated in a laboratory size press with the solutions shown in Table 4 below and their recording properties compared. The sheets prepared using the salt alone on the recording surface provide diminished waterfastness and poor feathering. Optical density is also unsatisfactory at the lower salt concentration. The use of the resin alone results in a recording sheet which exhibits high offset and relatively poor optical density. The combined use of the resin and salt in accordance with the invention provides excellent image intensity and waterfastness and satisfactory offsetting. Curl is also reduced to lower levels than achieved using either the salt or resin alone.

TABLE 4

| | | | | | | Recording Characteristics | | | | |
|---|---|---|---|---|---|---|---|---|---|---|
| Sample | Calcium Formate (parts) | Warcofix* 808 (parts) | Water (parts) | Calcium Formate ($g/m^2$) | Warcofix* 808 ($g/m^2$) | Intensity O.D. | Offsetting (Sec. to No Ink Set-Off | Waterfastness (Loss in O.D. From 1 Min. Soak) | Feathering (% Increase in Perimeter of Trace Line) | Curl ($m^{-1}$) |
| A | — | — | — | 0 | 0 | 1.13 | 4 | 0.42 | 174 | 67 |
| B | 50 | — | 950 | 1.3 | 0 | 1.19 | 2.5 | 0.06 | 102 | 32 |
| C | 100 | — | 900 | 2.6 | 0 | 1.27 | 4.5 | 0.05 | 122 | 31 |
| D | — | 255 | 754 | 0 | 3.30 | 1.15 | 10 | 0 | 56 | 29 |
| E | 75 | 143.4 | 781.6 | 1.45 | 1.45 | 1.29 | 5 | 0 | 46 | 21 |
| F | 150 | 286.8 | 563.2 | 3.05 | 3.05 | 1.36 | 5 | 0 | 46 | 23 |

*A product of Sun Chemical Corp.

EXAMPLE 5

A transparent recording sheet was prepared by washing a sheet of polyethylene terephtalate transparency with alcohol and subjecting it to corona discharge. The sheet was then coated with a coating composition consisting of 20 parts Nalco 8674 electroconductive resin, 20 parts calcium formate, and 20 parts Witco 216 resin (Witco Chemical Co.) and the balance water. The sheet was dried and sprayed with ink jet ink as described above. Whereas the ink beads up as it dries on the untreated sheet, it does not on the treated sheet.

EXAMPLE 6

A coated paper in accordance with the present invention was prepared by coating one side of an internally sized bond paper raw stock with a coating composition prepared by adding 7 parts by weight Warcofix 808 cationic polymer (a product of Sun Chemical Corp.) and 3 parts aluminum chlorohydrate to 100 parts of a composition containing 20 parts gelatin and 80 parts baryta. The composition was used to prepare an aqueous slurry containing 20% solids which was coated on the raw stock in coat weight of 8.2 $g/m^2$. For comparison, a coated paper was prepared using a coating composition containing 20 parts gelatin and 80 parts baryta but no cationic polymer or alumninum chlorohydrate. This composition was applied as an aqueous slurry containing 20% solids in a dry coat weight of 7.9 $g/m^2$. Each paper was sprayed with an aqueous black direct dye ink jet ink in an amount of 12 $g/m^2$. The recording characteristics of the two sheets are shown in Table 5 below.

TABLE 5

| | Coat Wt. | Optical Density | Waterfastness |
|---|---|---|---|
| Invention | 8.2 $g/m^2$ | 1.27 | 0 |
| Comparison | 7.9 $g/m^2$ | 1.27 | .08 |

The results in Table 5 show that gelatin-baryta coatings provide good ink jet recording density. The cationic polymer and salt do not detract from this recording property and significantly improve waterfastness.

EXAMPLE 7

Coated recording sheets were prepared in accordance with the present invention by applying to one side of an internally sized bond raw stock a coating composition prepared by adding 15 parts Warcofix 808 and 5 parts aluminum chlorohydrate to 100 parts of a composition containing 10 parts polyvinyl alcohol (Elvanol 71-30, a product of DuPont) and 90 parts baryta. The coating was applied as an aqueous slurry containing 20% solids in a dry coat weight of 11.7 g/m$^2$. For comparison, the same composition exclusive of the Warcofix 808 and aluminum chlorohydrate was applied to the raw stock in a coat weight of 8.5 g/m$^2$. The recording properties of the two sheets are shown in Table 6.

TABLE 6

| | Coat Wt. | Optical Density | Waterfastness |
|---|---|---|---|
| Invention | 11.7 g/m$^2$ | 1.24 | 0 |
| Comparison | 8.5 g/m$^2$ | 1.12 | 0.62 |

The results in Table 6 show that in PVA-baryta coatings, the cationic polymer and salt improve both optical density and waterfastness. Comparison with the results in Table 5 indicates that the cationic polymer and salt can be used to improve the recording properties of a less expensive coating such as PVA-baryta to a level approaching the recording properties of a more expensive gelatin-baryta paper.

Having described the invention in detail and by reference to specific embodiments thereof, it will be apparent that numerous modifications and variations are possible without departing from the spirit and scope of the invention defined by the following claims.

What is claimed is:

1. A recording sheet useful in ink jet recording comprising a substrate having a recording surface containing a cationic polymer and a water soluble polyvalent metal salt, said polymer providing said surface with cationic groups for ionically interacting with an anionic dye and insolubilizing it; wherein at least 3 mol % of the monomeric units making up said polymer are derived from cationic monomers and said salt is a salt of a metal from Group II, Group III, or the Transition Metals of the Periodic Table of Elements.

2. The recording sheet of claim 1 wherein said cationic polymer is water soluble.

3. The recording sheet of claim 2 wherein said polymer is a cationic polyamine.

4. The recording sheet of claim 3 wherein said polyamine has a nitrogen content in excess of 1.5% by weight.

5. The recording sheet of claim 3 wherein said polyvalent metal salt is a salt of a cation selected from the group consisting of $Ca^{2+}$, $Ba^{2+}$, $Zn^{2+}$, $Zr^{4+}$, $Al^{3+}$, and $Mg^{2+}$.

6. The recording sheet of claim 5 wherein said salt is a salt of an acid having a pKa greater than 2.0.

7. The recording sheet of claim 5 wherein said salt is a salt of an acid having a pka greater than 3.0.

8. The recording sheet of claim 7 wherein said salt is an acetate, a formate, a chlorohydrate, a malonate or a succinate.

9. The recording sheet of claim 2 wherein at least 10 mol % of the polymeric units forming said cationic polymer are derived from cationic monomers.

10. The recording sheet of claim 9, wherein said salt is calcium formate.

11. The recording sheet of claim 10, wherein said cationic polymer is a guanidine formaldehyde polymer.

12. The recording sheet of claim 1 wherein said salt is present in said surface in an amount of approximately 25 to 200 parts by weight per 100 parts by weight of said cationic polymer.

13. The recording sheet of claim 1 wherein said salt and said cationic polymer are present in said surface in a combined amount of approximately 0.1 to 15 g/m$^2$.

14. The recording sheet of claim 1 wherein said substrate is selected from the group consisting of paper, synthetic paper, and plastic film.

15. The recording sheet of claim 1 wherein said substrate is paper.

16. The recording sheet of claim 15 wherein said recording surface is formed by contacting a formed sheet of paper with an aqueous solution of said salt and said polymer.

17. The recording sheet of claim 16 wherein said solution is applied to said paper in a size press.

18. The recording sheet of claim 15 wherein said recording surface comprises a coating which overlies the surface of said paper.

19. The recording sheet of claim 18 wherein said coating additionally includes a water penetratable or water swellable binder.

20. The recording sheet of claim 19 wherein said coating additionally includes a white filler.

21. The recording sheet of claim 15 wherein said substrate is low size paper.

22. The recording sheet of claim 1 wherein said surface additionally includes a surfactant which enhances the wetting of said surface by an aqueous ink.

23. The recording sheet of claim 1 wherein said surface additionally includes a high absorbancy pigment.

24. The recording sheet of claim 1 wherein said salt is a zirconium salt.

25. In a method for ink jet recording which comprises jetting a stream of ink droplets onto the surface of a substrate, the improvement which comprises said substrate having on at least one of the major surfaces thereof a recording surface including a water soluble polyvalent metal salt and a cationic polymer, said polymer providing said surface with cationic groups for ionically interacting with an anionic dye and insolubilizing it; wherein at least 3 mol % of the monomeric units making up said polymer are derived from cationic monomers and said salt is a salt of a metal from Group II, Group III, or the Transition Metals of the Periodic Table of Elements.

26. The method of claim 25 wherein said cationic polymer is water soluble.

27. The method of claim 26 wherein said cationic polymer is a cationic polyamine.

28. The method of claim 27 said polyvalent metal salt is a salt of a cation selected from the group consisting of $Ca^{2+}$, $Ba^{2+}$, $Zn^{2+}$, $Al^{3+}$, $Zr^{4+}$, and $Mg^{2+}$.

29. The method of claim 28 wherein said salt is a salt of an acid having a pKa greater than 2.0.

30. The method of claim 29 wherein said salt is an acetate, a formate, a chlorohydrate, a malonate or a succinate.

* * * * *